US012416457B2

(12) United States Patent
Cho et al.

(10) Patent No.: US 12,416,457 B2
(45) Date of Patent: Sep. 16, 2025

(54) HEAT EXCHANGER

(71) Applicant: SAMSUNG ELECTRONICS CO., LTD., Suwon-si (KR)

(72) Inventors: Hyunchul Cho, Suwon-si (KR); Kangtae Seo, Suwon-si (KR); Jeungku Choi, Suwon-si (KR); Yonghwa Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 126 days.

(21) Appl. No.: 18/228,440

(22) Filed: Jul. 31, 2023

(65) Prior Publication Data

US 2024/0118045 A1 Apr. 11, 2024

Related U.S. Application Data

(63) Continuation of application No. PCT/KR2023/008803, filed on Jun. 26, 2023.

(30) Foreign Application Priority Data

Oct. 6, 2022 (KR) ..... 10-2022-0128168

(51) Int. Cl.
*F28F 9/02* (2006.01)
*F28D 1/047* (2006.01)
*F28F 9/18* (2006.01)

(52) U.S. Cl.
CPC ..... *F28F 9/0256* (2013.01); *F28D 1/0477* (2013.01); *F28F 9/18* (2013.01); *F28F 2275/04* (2013.01); *F28F 2275/06* (2013.01)

(58) Field of Classification Search
CPC ..... F28D 1/0477; F28F 1/32; F28F 9/0256; F28F 9/18; F28F 2275/04; F28F 2275/06
See application file for complete search history.

(56) References Cited

U.S. PATENT DOCUMENTS 4,076,167 A * 2/1978 Wright ..... B23K 3/0684 228/183
5,398,981 A * 3/1995 Barton ..... F28F 9/26 285/382

(Continued)

FOREIGN PATENT DOCUMENTS

JP 2013-217584 10/2013
JP 2014-126311 7/2014

(Continued)

OTHER PUBLICATIONS

Machine Translation of KR 10-0893745 (Year: 2025).*

(Continued)

*Primary Examiner* — Eric S Ruppert
*Assistant Examiner* — Hans R Weiland
(74) *Attorney, Agent, or Firm* — STAAS & HALSEY LLP

(57) ABSTRACT

A heat exchanger including a heat exchange fin; a refrigerant pipe passing through the heat exchange fin, the refrigerant pipe having a first thickness; a connecting member coupled to the refrigerant pipe; and a distribution pipe coupled to the connecting member at an outside of the heat exchange fin, the distribution pipe having a second thickness greater than the first thickness, wherein the connecting member is positioned between the refrigerant pipe and the distribution pipe so that a refrigerant is flowable through the connecting member between the refrigerant pipe and the distribution pipe, and has a thickness in a range of 95% or more and 105% or less of the second thickness.

13 Claims, 11 Drawing Sheets

(56) References Cited

U.S. PATENT DOCUMENTS

| | | | | |
|---|---|---|---|---|
| 6,860,324 | B2 | 3/2005 | Kato et al. | |
| 10,365,014 | B2 | 7/2019 | Nishino et al. | |
| 2010/0044023 | A1* | 2/2010 | Canales | F28F 9/26 29/890.047 |
| 2013/0319569 | A1* | 12/2013 | Kikuno | B23K 1/002 138/109 |
| 2016/0061536 | A1* | 3/2016 | Arment | F28F 9/262 165/181 |
| 2017/0114932 | A1* | 4/2017 | Nakajima | F28F 9/182 |
| 2024/0011722 | A1 | 1/2024 | Kim et al. | |
| 2024/0310096 | A1 | 9/2024 | Yanachi et al. | |

FOREIGN PATENT DOCUMENTS

| | | | |
|---|---|---|---|
| KR | 10-0558819 | | 3/2006 |
| KR | 3805628 | B2 | 8/2006 |
| KR | 100893745 | B1 * | 10/2008 |
| KR | 10-2009-0033743 | | 4/2009 |
| KR | 10-1401644 | | 6/2014 |
| KR | 10-1462152 | | 11/2014 |
| KR | 10-1547471 | B1 | 8/2015 |
| KR | 2016-200312 | A | 12/2016 |
| KR | 10-2323700 | B1 | 11/2021 |
| KR | 10-2022-0064685 | | 5/2022 |

OTHER PUBLICATIONS

International Search Report dated Oct. 12, 2023 for International Application No. PCT/KR2023/008803.
Written Opinion of the International Searching Authority dated Oct. 12, 2023 for International Application No. PCT/KR2023/008803.

* cited by examiner

HEAT EXCHANGER

CROSS-REFERENCE TO RELATED APPLICATION

This application is a continuation application, under 35 U.S.C. § 111(a), of international application No. PCT/KR2023/008803, filed on Jun. 26, 2023, which claims priority to Korean Patent Application No. 10-2022-0128168, filed on Oct. 6, 2022, in the Korean Intellectual Property Office, the disclosures of which are incorporated by reference herein in their entireties.

BACKGROUND

Field

The present disclosure relates to a heat exchanger having an improved structure to reduce the defect rate in a manufacturing process.

Description of the Related Art

In general, a heat exchanger is a device used in a refrigeration cycle and serves as a condenser or an evaporator.

The heat exchanger is a device equipped with a refrigerant pipe through which a refrigerant flows while exchanging heat with outside air and a heat exchange fin making contact with the refrigerant pipe to increase a heat dissipation area, to heat-exchange between the refrigerant and outside air.

In addition, the heat exchanger may include a distribution pipe for supplying a refrigerant to the refrigerant pipe, and a bending pipe coupled to an end of the refrigerant pipe to change a flow direction of the refrigerant in the refrigerant pipe.

The refrigerant pipe and the distribution pipe of the heat exchanger may be coupled by welding. In this case, since the thicknesses of the cross sections of the refrigerant pipe and the distribution pipe are different from each other, welding defects may occur due to the heat capacity imbalance.

SUMMARY

Aspects of embodiments of the disclosure will be set forth in part in the description which follows and, in part, will be apparent from the description, or may be learned by practice of the presented embodiments.

According to an embodiment of the disclosure, a heat exchanger includes a heat exchange fin; a refrigerant pipe passing through the heat exchange fin, the refrigerant pipe having a first thickness; a connecting member coupled to the refrigerant pipe; and a distribution pipe coupled to the connecting member at an outside of the heat exchange fin, the distribution pipe having a second thickness greater than the first thickness, wherein the connecting member is positioned between the refrigerant pipe and the distribution pipe so that a refrigerant is flowable through the connecting member between the refrigerant pipe and the distribution pipe, and has a thickness in a range of 95% or more and 105% or less of the second thickness.

According to an embodiment of the disclosure, the connecting member may include a connecting body configured to be in contact with the refrigerant pipe and the distribution pipe, and an expansion flange formed on an upper end of the connecting body and extending upward and outward from the connecting body such that an inner diameter of the expansion flange increases along a length of the expansion flange.

According to an embodiment of the disclosure, the connecting body may include a first connecting body, a second connecting body having an inner diameter that is larger than an inner diameter of the first connecting body, and being formed on an upper side of the first connecting body, and a connecting expansion portion connecting the first connecting body and the second connecting body, and obliquely extending from the first connecting body to the second connecting body.

According to an embodiment of the disclosure, the distribution pipe may include an insertion portion inserted into the connecting body, an expansion pipe portion extending upward from the insertion portion and supported by the expansion flange of the connecting member, and an extension portion extending upward from the expansion pipe portion and having an inner diameter that is larger than an inner diameter of the insertion portion.

According to an embodiment of the disclosure, the connecting member may be coupled to the refrigerant pipe such that the connecting body is inserted into the refrigerant pipe, and coupled to the distribution pipe such that the distribution pipe is inserted into the connecting body.

According to an embodiment of the disclosure, the refrigerant pipe may include a refrigerant pipe body, and a refrigerant pipe expansion portion extending upward from the refrigerant pipe body such that an inner diameter of the refrigerant pipe expansion portion increases as in an upward direction, the refrigerant pipe expansion portion being configured to support an outer surface of the connecting expansion portion.

According to an embodiment of the disclosure, the refrigerant pipe may be configured as a plurality of refrigerant pipes, and the heat exchanger may further include a bending pipe having the second thickness and coupled to open ends of two refrigerant pipes disposed side by side among the plurality of refrigerant pipes to connect the two refrigerant pipes.

According to an embodiment of the disclosure, the connecting member may have a net volume greater than or equal to 65%, and less than or equal to 135%, of a net volume of the bending pipe.

According to an embodiment of the disclosure, the connecting member and the bending pipe may be automatically welded to the refrigerant pipe.

According to an embodiment of the disclosure, the distribution pipe may be manually welded to the connecting member after the bending pipe and the connecting member are welded.

According to an embodiment of the disclosure, the first thickness may be greater than or equal to 0.45 mm and less than or equal to 0.55 mm, and the second thickness may be greater than or equal to 0.9 mm and less than or equal to 1.1 mm.

According to an embodiment of the disclosure, the heat exchanger may further include an aluminum solder disposed between the refrigerant pipe and the connecting member and coupling the connecting member and the refrigerant pipe together.

According to an embodiment of the disclosure, the refrigerant pipe, the distribution pipe, and the connecting member may include an aluminum material, the refrigerant pipe and the connecting member may be welded together, and the connecting member and the distribution pipe may be welded together.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
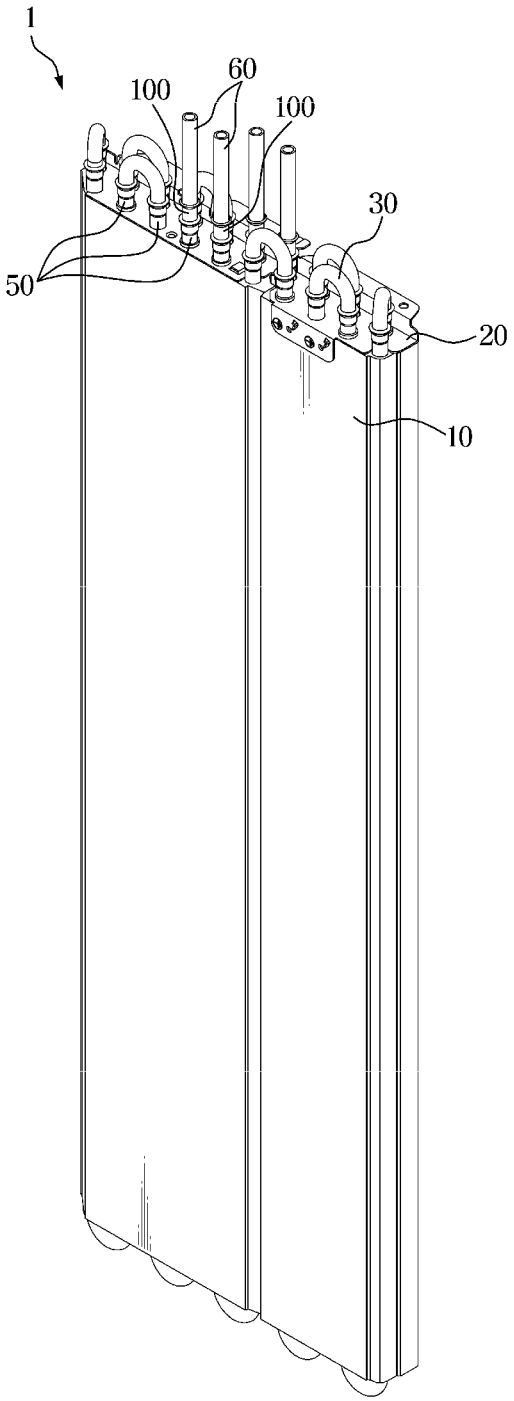
FIG. 1 is a perspective view illustrating a heat exchanger according to an embodiment of the disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit and/or restrict the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc., may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed articles.

Embodiments of the disclosure may provide a heat exchanger having an improved structure to reduce a defect rate during welding of the heat exchanger. The technical objectives of the present disclosure are not limited to those described herein, and other objectives may become apparent to those of ordinary skill in the art based on the following description.

Hereinafter, embodiments according to the disclosure will be described in detail with reference to the accompanying drawings.

Figure 2:
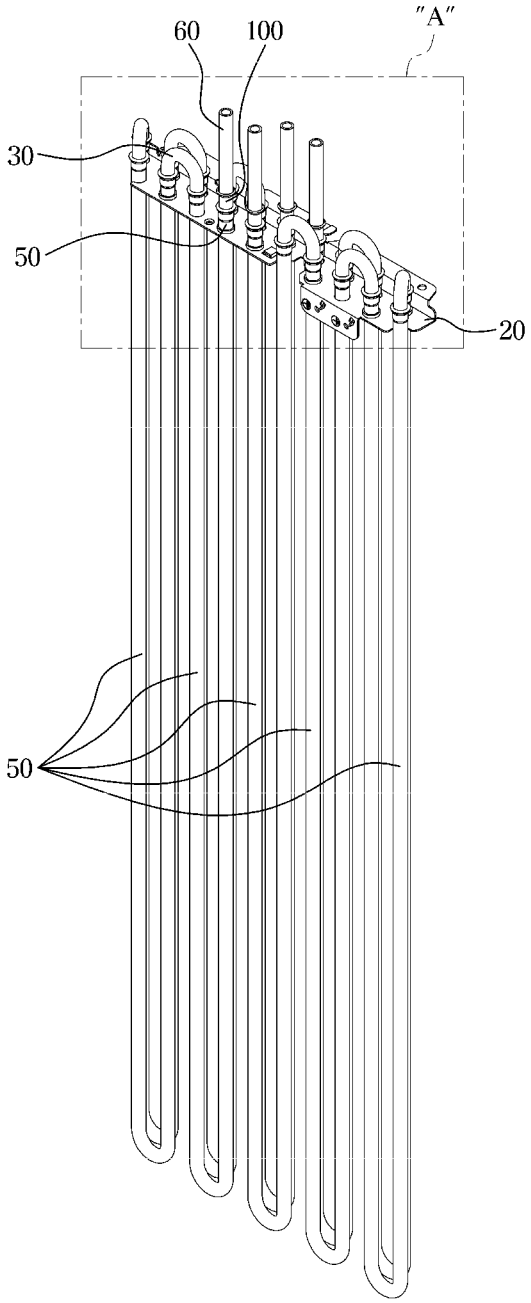
FIG. 2 is a view illustrating the heat exchanger shown in FIG. 1 by omitting the heat exchange fins.
Figure 3:
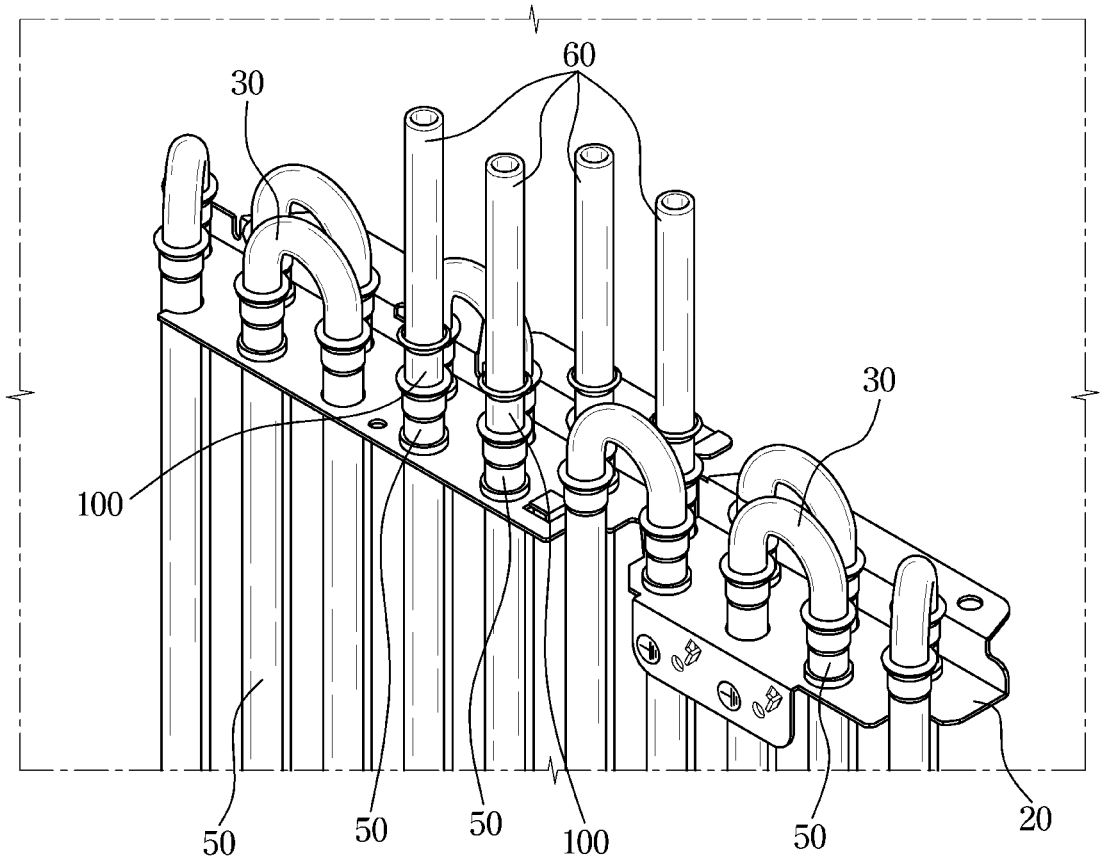
FIG. 3 is an enlarged view of part A of FIG. 2.

FIG. 1 is a perspective view illustrating a heat exchanger according to an embodiment. FIG. 2 is a view illustrating the heat exchanger shown in FIG. 1 by omitting the heat exchange fins. FIG. 3 is an enlarged view of part A of FIG. 2.

Referring to FIGS. 1 to 3, a heat exchanger 1 may include a plurality of refrigerant pipes 50 through which refrigerant flows, and heat exchange fins 10 disposed outside of the plurality of refrigerant pipes 50.

The insides of the plurality of refrigerant pipes 50 may have an inside that is open to form a passage in which a refrigerant, which is a fluid, flows such that a refrigerant is caused to flow.

The plurality of refrigerant pipes 50 may be provided as refrigerant tubes. A microchannel refrigerant tube may be used as the refrigerant pipe. A microchannel refrigerant tube may be defined as a tube having a hydraulic diameter of 3 mm or less. A hydraulic diameter is a value obtained by dividing the cross-sectional area of a tube by the circumference of the tube.

The refrigerant may be compressed or expanded while flowing along the passage formed in the refrigerant pipe 50 to release heat or absorb heat to or from the surroundings. A heat exchange fin 10 may be coupled to the refrigerant pipe 50 such that the refrigerant efficiently releases or absorbs heat while being compressed or expanded.

A plurality of the heat exchange fins 10 are shown in FIG. 1 rather than a single unit, and the heat exchanger 1 according to the disclosure may be provided with a plurality of the heat exchange fins 10.

The plurality of heat exchange fins 10 may be spaced apart from each other at regular intervals in a direction perpendicular to the direction in which the refrigerant pipe 50 extends. The heat exchange fin 10 may include an aluminum alloy material having high thermal conductivity.

The heat exchange fin 10 may be bonded to the outer surface of the refrigerant pipe 50 to substantially increase a heat exchange area between outside air and the refrigerant pipe 50.

As the interval at which the heat exchange fins 10 are stacked decreases, a larger number of heat exchange fins 10 may be disposed. However, when the interval between the heat exchange fins 10 is excessively narrow, the heat exchange fins 10 may act as resistance to the flow of outside air flowing toward the heat exchanger 1. Therefore, the interval between the heat exchange fins 10 may be appropriately adjusted to minimize the pressure loss.

The heat exchanger 1 may include a support plate 20.

The refrigerant pipe 50 may be disposed such that an end of the refrigerant pipe 50 passes through the support plate 20. For example, a portion of the refrigerant pipe 50 may be disposed inside of the support plate 20 with respect to the support plate 20, and another portion of the refrigerant pipe 50 may be disposed outside of the support plate 20 with respect to the support plate 20. Ends of the refrigerant pipes 50 disposed outside of the support plate 20 may be coupled to a bending pipe 30 and a connecting member 100.

For example, the refrigerant pipe 50 may be connected to a distribution pipe 60 outside of the support plate 20 by passing through the support plate 20 such that the refrigerant pipe 50 may be supplied with a refrigerant or may discharge a heat-exchanged refrigerant.

The refrigerant pipes 50 may be arranged in a plurality of rows.

For example, as a part through which a refrigerant is introduced, the refrigerant pipes 50 may be disposed side by side at one side of the support plate 20. The refrigerant pipes 50 may be disposed along the first row to correspond to the one side of the support plate 20.

The refrigerant pipes 50 may be arranged side by side on the other side of the support plate 20 opposite to the one side of the support plate 20. For example, as a part through which a refrigerant is discharged, the refrigerant pipes 50 may be disposed along the second row on the other side of the support plate 20.

The first row and the second row may correspond to the front side and the rear side, respectively, of the drawing. However, the directions may vary according to the arrangement direction of the heat exchanger 1.

In addition, parts of a single refrigerant pipe 50 may be disposed in both the first row and the second row, respectively.

The distribution pipe 60 may be provided in plural. The plurality of distribution pipes 60 may be connected to the refrigerant pipes 50 disposed in the first row.

Through the plurality of distribution pipes 60 connected to the refrigerant pipes 50 disposed in the first row, the refrigerant may flow from the distribution pipes 60 into the refrigerant pipes 50.

The plurality of distribution pipes 60 may be connected to the refrigerant pipes 50 disposed in the second row.

Through the plurality of distribution pipes 60 connected to the refrigerant pipes 50 disposed in the second row, the refrigerant having completed heat exchange may flow out from the refrigerant pipes 50 to the distribution pipes 60.

Although the plurality of distribution pipes 60 are illustrated as two distribution pipes in the first row and two distribution pipes in the second row, the number of distribution pipes 60 may not be limited thereto.

The bending pipe 30 may be provided to connect two adjacent refrigerant pipes 50 among the plurality of refrigerant pipes 50.

For example, a refrigerant pipe 50 may have two open ends. In addition, the refrigerant pipe 50 may have a bent portion that is bent to change the flow direction of the refrigerant and formed at a position opposite to the two open ends.

One of the open ends of the refrigerant pipe 50 may be connected to one of the plurality of distribution pipes 60 such that the refrigerant flows into the refrigerant pipe 50.

The other one of the open ends of the refrigerant pipe 50 may be connected to the bending pipe 30. Open ends of two adjacent refrigerant pipes 50 may be connected to each other by a bending pipe 30.

Therefore, the refrigerant introduced into the refrigerant pipe 50 is caused to flow along the passage inside the refrigerant pipe 50, change in direction by the bent portion of the refrigerant pipe 50, and flow to another refrigerant pipe 50 adjacent thereto by the bending pipe 30.

In addition, one open end and the other open end of the refrigerant pipe 50 may be coupled to different bending pipes 30 to form a passage through which a refrigerant moves.

The heat exchange fins 10 may be disposed inside of the support plate 20 based on the support plate 20. The heat exchange fin 10 may be provided in any shape such that the refrigerant pipe 50 may efficiently release or absorb heat.

As shown in detail in FIG. 3, the bending pipe 30 and the connecting member 100 may be coupled to the refrigerant pipes 50. For example, the distribution pipe 60 may be connected to the refrigerant pipe 50 through the connecting member 100.

The distribution pipe 60 shown in FIGS. 1 to 3 is illustrated by omitting a portion through which the refrigerant flows in or out, and the shape of the distribution pipe 60 may vary depending on the installation situation of the heat exchanger 1. In general, the shape of the distribution pipe 60 may be provided in a complex shape, unlike the bending pipe 30 or the connecting member 100.

Therefore, welding for connecting the distribution pipe 60 with the refrigerant pipe 50 is difficult to perform in an automatic manner, and it is required to be performed manually by a skilled technician.

The bending pipe 30, the solder, the refrigerant pipe 50, the connecting member 100, and the distribution pipe 60 of the heat exchanger 1 according to the disclosure may be provided to include an aluminum material.

Hereinafter, the connecting member 100 configured to reduce the defect rate in a manual welding of aluminum will be described in detail.

Figure 4:
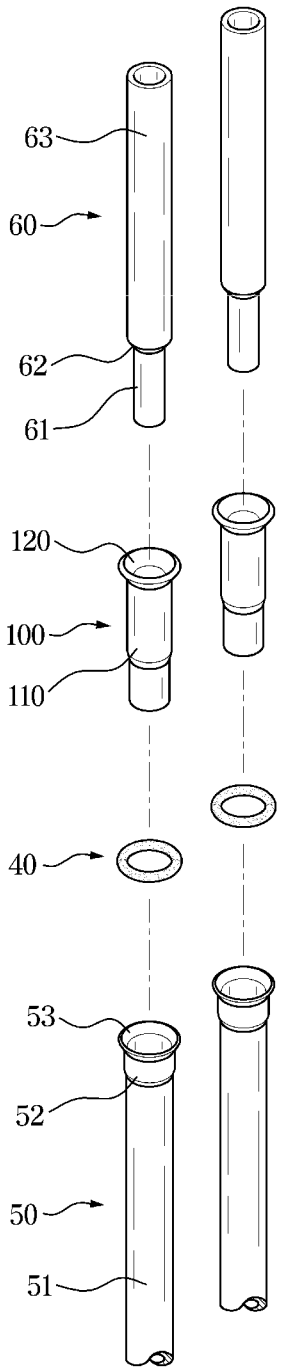
FIG. 4 is an exploded view illustrating a refrigerant pipe, a solder, a connecting member, and a distribution pipe of a heat exchanger according to an embodiment of the disclosure.
Figure 5:
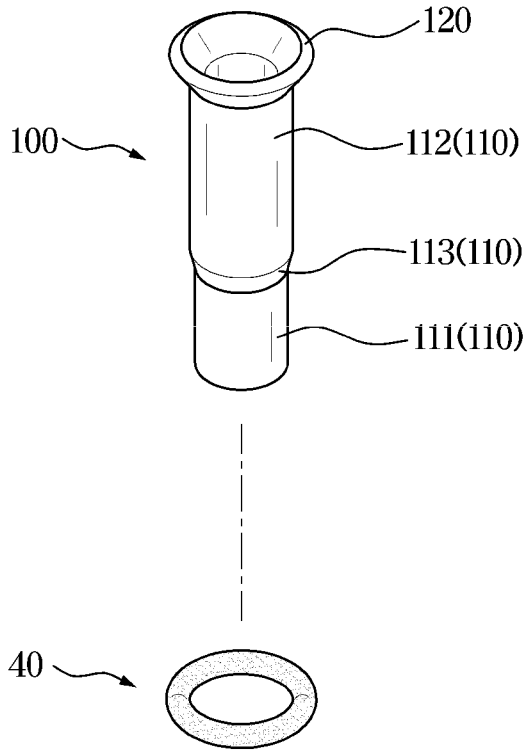
FIG. 5 is an exploded view illustrating the connecting member and the solder shown in FIG. 4.

FIG. 4 is an exploded view illustrating a refrigerant pipe, a solder, a connecting member, and a distribution pipe of a heat exchanger according to an embodiment. FIG. 5 is an exploded view illustrating the connecting member and the solder shown in FIG. 4.

Referring to FIGS. 4 and 5, the connecting member 100 may be disposed between the refrigerant pipe 50 and the distribution pipe 60 to connect the refrigerant pipe 50 and the distribution pipe 60.

For example, the connecting member 100 may be coupled to each of the refrigerant pipe 50 and the distribution pipe 60 between the refrigerant pipe 50 and the distribution pipe 60.

For example, the connecting member 100 may have a portion inserted into the refrigerant pipe 50, and another portion into which the distribution pipe 60 is inserted.

The refrigerant pipe 50 may include a refrigerant pipe body 51, a refrigerant pipe expansion portion 52, and a refrigerant pipe flange 53.

The refrigerant pipe body 51 may have a hollow inside that is open such that the refrigerant flows therein. The refrigerant pipe body 51 may be elongated along the flow direction of the refrigerant.

The refrigerant pipe expansion portion 52 may be formed at one side of the refrigerant pipe body 51. The refrigerant pipe expansion portion 52 may have an inner diameter gradually increasing toward the open end of the refrigerant pipe 50. The inner surface of the refrigerant pipe expansion portion 52 may be obliquely formed.

The refrigerant pipe expansion portion 52 may be provided to correspond to the shape of a connecting expansion portion (113 in FIG. 5) of the connecting member 100. The refrigerant pipe expansion portion 52 may be provided to support the connecting member 100 in a state in which the connecting member 100 is inserted into the refrigerant pipe 50.

For example, the refrigerant pipe expansion portion 52 may extend from the refrigerant pipe body 51 such that an inner diameter thereof increases as being directed upward. The refrigerant pipe expansion portion 52 may support the connecting expansion portion 113 of the connecting member 100, which will be described below, at the outside.

The refrigerant pipe flange 53 may be formed at the open end of the refrigerant pipe 50. The refrigerant pipe flange 53 may have an inner diameter that gradually increases as being directed outward.

For example, the refrigerant pipe flange 53 may extend upward from the refrigerant pipe body 51.

The refrigerant pipe flange 53 may be provided to support an aluminum solder 40. The aluminum solder 40 may be seated on the refrigerant pipe flange 53 to allow the connecting member 100 and the refrigerant pipe 50 to be coupled through welding.

The refrigerant pipe flange 53 may be provided to accommodate the aluminum solder 40 in a liquid state to prevent the aluminum solder 40 from overflowing to the outside of the refrigerant pipe 50 when the solder melts.

The connecting member 100 may include a connecting body 110 and an expansion flange 120.

The connecting body 110 may have a portion inserted into the refrigerant pipe 50 and another portion into which the distribution pipe 60 is inserted. For example, the connecting body 110 may have a lower portion inserted into the refrigerant pipe 50. The distribution pipe 60 may be inserted into the connecting body 110 through an upper portion of the connecting body 110.

The connecting body 110 may be in contact with the refrigerant pipe 50 and the distribution pipe 60.

The expansion flange 120 may be formed at an upper end of the connecting body 110. The expansion flange 120 may extend from the connecting body 110 such that an inner diameter thereof gradually increases outward.

For example, the expansion flange 120 may extend upward from the connecting body 110 to be disposed outside of the distribution pipe 60 at a predetermined distance from the outer surface of the distribution pipe 60.

The expansion flange 120 may be provided to prevent overflow of solder to the outside during welding of the connecting body 110 and the distribution pipe 60.

The connecting body 110 may include a first connecting body 111, a second connecting body 112, and a connecting expansion portion 113.

The first connecting body 111 may be provided to be inserted into the refrigerant pipe 50. The first connecting body 111 may be accommodated inside the refrigerant pipe 50.

The second connecting body 112 may have an inner diameter that is larger than that of the first connecting body 111. The second connecting body 112 may be formed on the upper side of the first connecting body 111.

The second connecting body 112 may have one portion inserted into the refrigerant pipe 50 and another portion disposed outside the refrigerant pipe 50 to be exposed to the outside.

The connecting expansion portion 113 may connect the first connecting body 111 and the second connecting body 112 and obliquely extend from the first connecting body 111. The connecting expansion portion 113 may have an inner diameter that gradually increases toward the second connecting body 112.

The connecting expansion portion 113 may have a lower inner diameter provided the same as the inner diameter of the first connecting body 111, and an upper inner diameter provided the same as the inner diameter of the second connecting body 112.

The connecting expansion portion 113 may be provided to support an end of the distribution pipe 60. For example, when the distribution pipe 60 is inserted into the connecting member 100, the lower end of the distribution pipe 60 may be inserted up to a portion at which the connecting expansion portion 113 of the connecting member 100 is formed.

The expansion flange 120 of the connecting member 100 may be formed on the upper side of the second connecting body 112 and may extend from the second connecting body 112 such that an inner diameter thereof increases outward.

The distribution pipe 60 may include an insertion portion 61, an expansion pipe portion 62, and an extension portion 63.

The insertion portion 61 may be provided to be inserted into the connecting body 110. For example, the insertion portion 61 may be inserted into the second connecting body 112 and accommodated inside the second connecting body 112.

An end of the insertion portion 61 may be supported by the connecting expansion portion 113 of the connecting member 100.

The expansion pipe portion 62 may extend upward from the insertion portion 61. The expansion pipe portion 62 may be supported on the expansion flange 120 of the connecting member 100.

For example, while the distribution pipe 60 is inserted inside the connecting member 100, the expansion pipe portion 62 may be seated on the inner surface of the expansion flange 120 of the connecting member 100.

The extension portion 63 may be provided to extend upward from the expansion pipe portion 62 and have an inner diameter that is larger than that of the insertion portion 61.

The heat exchanger 1 may include an aluminum solder 40.

The aluminum solder 40 may be disposed between the refrigerant pipe 50 and the connecting member 100 such that the connecting member 100 and the refrigerant pipe 50 are coupled to each other by welding.

The aluminum solder 40 may be formed of an aluminum alloy similar to the base material. In an automatic welding operation, the aluminum solder 40 may be seated on the refrigerant pipe flange 53 of the refrigerant pipe 50 to bond the refrigerant pipe 50 and the connecting member 100, and bond the refrigerant pipe 50 and the bending pipe 30.

Figure 6:
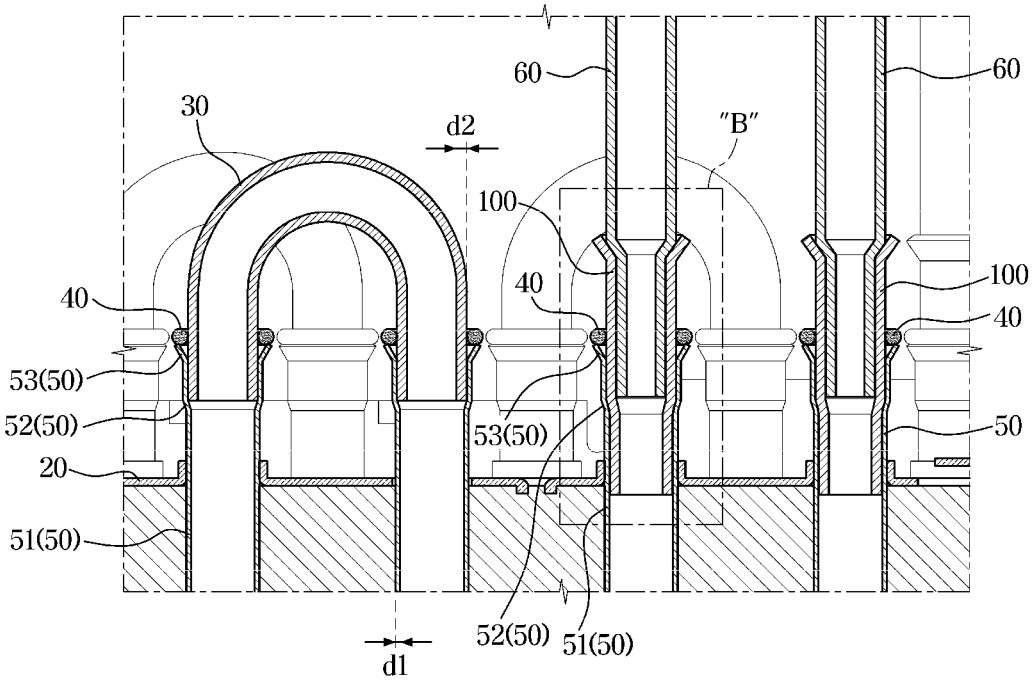
FIG. 6 is a cross-sectional view illustrating a heat exchanger according to an embodiment of the disclosure.
Figure 7:
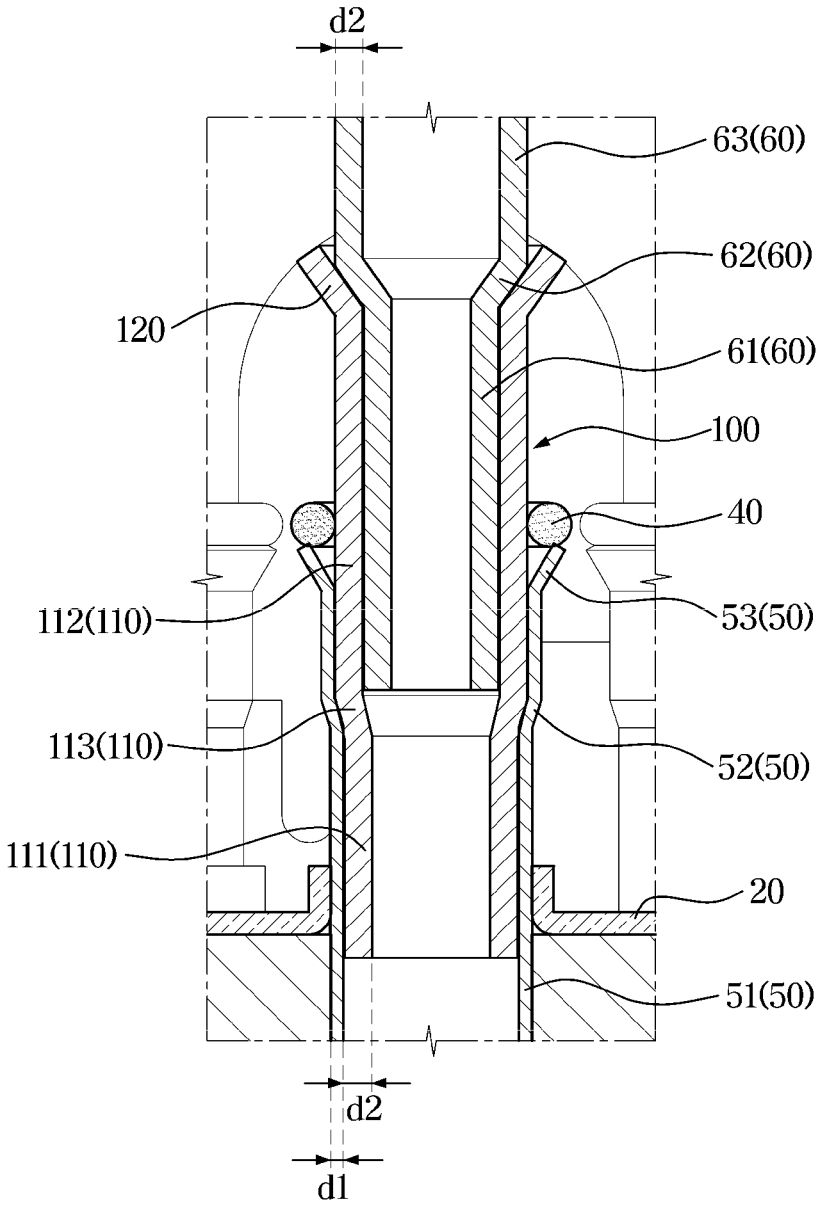
FIG. 7 is an enlarged view of part B of FIG. 6.

FIG. 6 is a cross-sectional view illustrating a heat exchanger according to one embodiment. FIG. 7 is an enlarged view of part B of FIG. 6.

Referring to FIGS. 6 and 7, the thickness of the refrigerant pipe 50 may be provided with a first thickness d1. The thickness of the refrigerant pipe 50 may be defined as the difference between the outer diameter of the refrigerant pipe 50 and the inner diameter of the refrigerant pipe 50.

The thickness of the distribution pipe 60 may be provided with a second thickness d2 greater than the first thickness d1 of the refrigerant pipe 50. The thickness of the connecting member 100 may be provided with the second thickness d2. The thickness of the bending pipe 30 may be provided with the second thickness d2.

However, the thickness of the connecting member 100 is not limited thereto, and may be provided similar to the thickness of the distribution pipe 60. For example, the thickness of the connecting member 100 may be provided within a range of 95% or more and 105% or less of the second thickness d2.

The thickness of the distribution pipe 60 may be defined as the difference between the outer diameter of the distribution pipe 60 and the inner diameter of the distribution pipe 60. The thickness of the connecting member 100 may be defined as the difference between the outer diameter of the connecting member 100 and the inner diameter of the connecting member 100. The thickness of the bending pipe 30 may be defined as the difference between the outer diameter of the bending pipe 30 and the inner diameter of the bending pipe 30.

The refrigerant pipe 50 is a pipe provided to allow a refrigerant to flow therein, and needs to be formed to have a relatively thin thickness to facilitate heat exchange of the refrigerant. However, the thickness of the refrigerant pipe 50 needs to be at a level that ensures pressure resistance sufficient to withstand the flow pressure of the refrigerant.

Accordingly, the first thickness d1 of the refrigerant pipe 50 may be provided approximately with 0.45 mm or more and 0.55 m or less. Preferably, the first thickness d1 of the refrigerant pipe 50 may be approximately 0.5 mm.

The distribution pipe 60 and the connecting member 100, and the bending pipe 30 are components connected to the refrigerant pipes 50 and disposed outside of the support plate 20, and exposed to the outside of the heat exchanger 1.

Therefore, the distribution pipe 60, the connecting member 100, and the bending pipe 30 need to have a relatively thick thickness to withstand external impact. In particular, the distribution pipe 60 is deformed according to the installation situation of the heat exchanger 1, and thus requires a relatively thick thickness to have durability against shape deformation.

Accordingly, the second thickness d2 of the distribution pipe 60, the connecting member 100, and the bending pipe 30 may be approximately 0.9 mm or more and 1.1 mm or less. Preferably, the second thickness d2 of the distribution pipe 60, the connecting member 100, and the bending pipe 30 the may be provided as approximately 1.0 mm.

For example, the second thickness d2 of each of the distribution pipe 60, the connecting member 100, and the bending pipe 30 may be approximately twice the first thickness d1.

Figure 8:
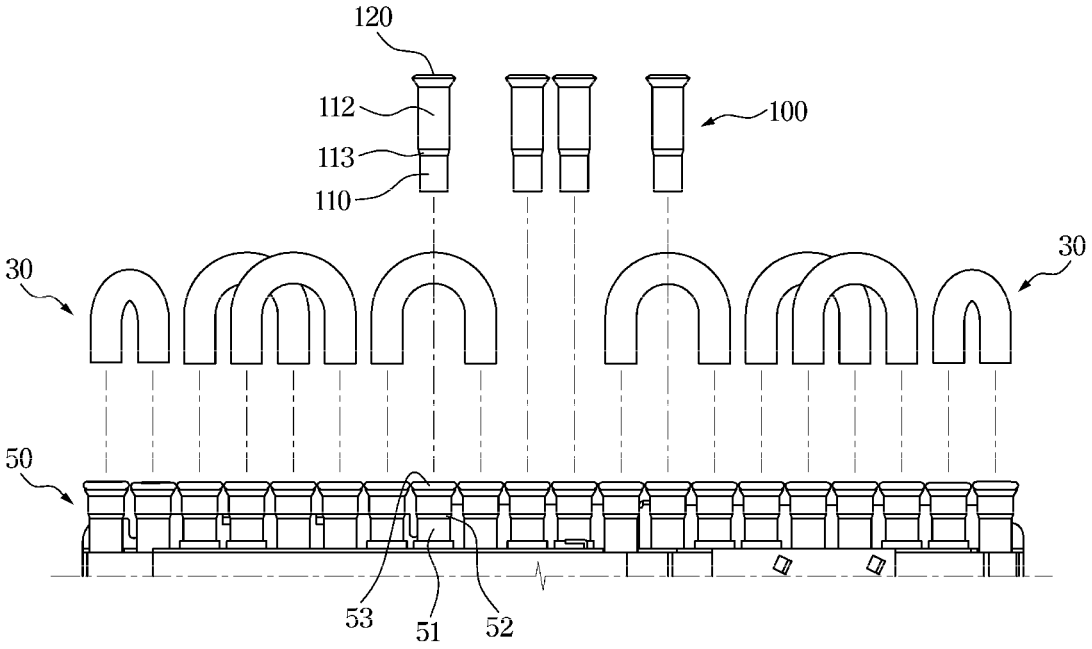
FIG. 8 is a view illustrating a process in which a bending pipe and a connecting member are coupled to refrigerant pipes in a manufacturing process of a heat exchanger according to an embodiment of the disclosure.
Figure 9:
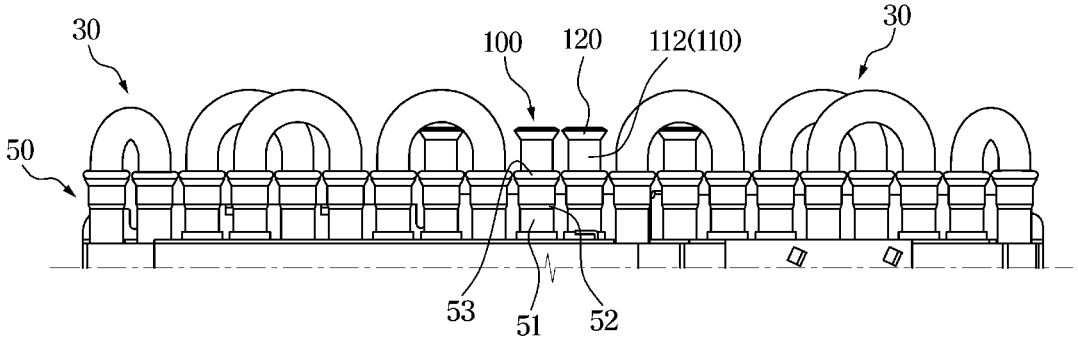
FIG. 9 is a view illustrating a state in which a bending pipe and a connecting member are coupled to refrigerant pipes in a manufacturing process of a heat exchanger according to an embodiment of the disclosure.
Figure 10:
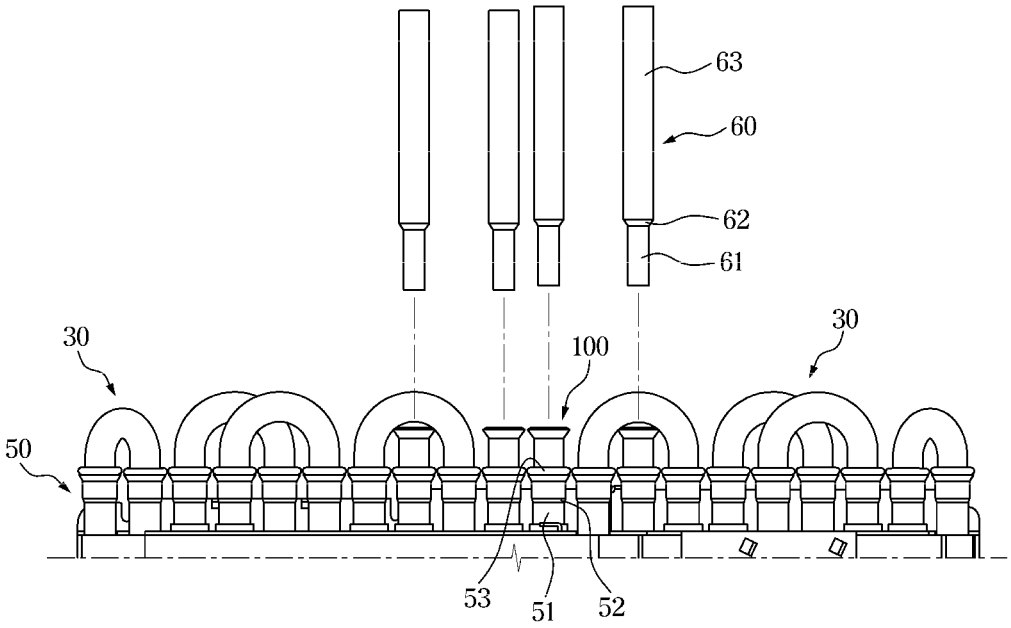
FIG. 10 is a view illustrating a process in which a distribution pipe is coupled to a connecting member in a manufacturing process of a heat exchanger according to an embodiment of the disclosure.
Figure 11:
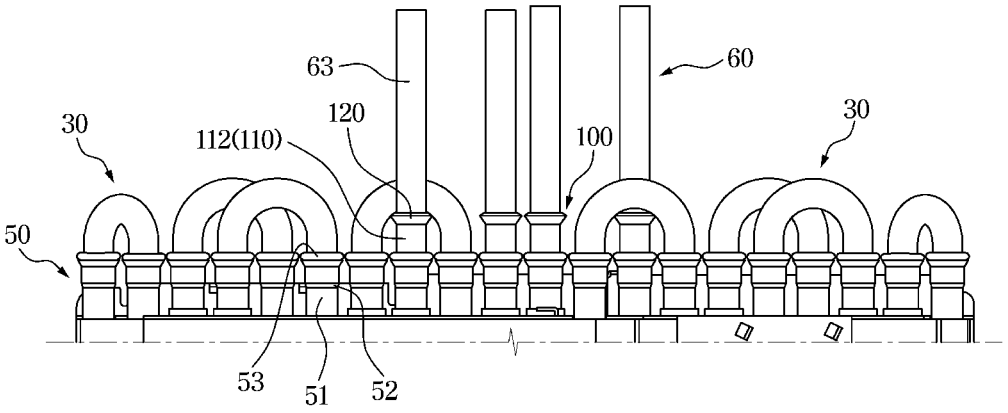
FIG. 11 is a view illustrating a state in which a distribution pipe is coupled to a connecting member in a manufacturing process of a heat exchanger according to an embodiment of the disclosure.

FIG. 8 is a view illustrating a process in which a bending pipe and a connecting member are coupled to refrigerant pipes in a manufacturing process of a heat exchanger according to an embodiment. FIG. 9 is a view illustrating a state in which a bending pipe and a connecting member are coupled to refrigerant pipes in a manufacturing process of a heat exchanger according to an embodiment. FIG. 10 is a view illustrating a process in which a distribution pipe is coupled to a connecting member in a manufacturing process of a heat exchanger according to an embodiment. FIG. 11 is a view illustrating a state in which a distribution pipe is coupled to a connecting member in a manufacturing process of a heat exchanger according to an embodiment.

Referring to FIGS. 8 to 9, a process in which the bending pipe 30 and the connecting member 100 are coupled to the refrigerant pipes 50 will be described.

The bending pipe 30 and the connecting member 100 may be coupled to open ends of the refrigerant pipes 50 through welding.

For example, a lower portion of the bending pipe 30 may be inserted into the refrigerant pipe body 51 of the refrigerant pipe 50. The connecting body 110 of the connecting member 100 may be inserted into the refrigerant pipe 50.

For example, the first connecting body 111, the connecting expansion portion 113, and a part of the second connecting body 112 of the connecting member 100 may be accommodated inside the refrigerant pipe body 51 of the refrigerant pipe 50.

The bending pipe 30 and the connecting member 100 may be automatically welded to the refrigerant pipes 50 while being inserted into the refrigerant pipes 50.

In this case, the range of the primary automatic welding may correspond to a lower part of the bending pipe 30, and the second connecting body 112 of the connecting member 100.

Referring to FIGS. 10 and 11, a process in which the distribution pipe 60 is coupled to the connecting member 100 will be described.

The distribution pipe 60 may be inserted into the connecting member 100. For example, the insertion portion 61 of the distribution pipe 60 may be accommodated inside the connecting body 110 by passing through the expansion flange 120 of the connecting member 100.

The shape of the distribution pipe 60 may be modified according to the arrangement of the heat exchanger 1. Therefore, when connecting the distribution pipe 60 to the refrigerant pipe 50, automatic welding may not be available, and manual welding may be required.

The distribution pipe 60 may be manually welded to the connecting member 100 while being inserted into the connecting member 100. In this case, the range of the secondary manual welding may correspond to a portion of an upper part of the second connecting body 112 of the connecting member 100, the expansion flange 120, the insertion portion 61 of the distribution pipe 60, the expansion pipe portion 62, and a portion of a lower part of the extension portion 63.

According to the disclosure, both the distribution pipe 60 and the refrigerant pipe 50 may be provided to include an aluminum material. In the case of aluminum, the difference in melting points between the aluminum solder 40 and the base material is only 45 to 50 degrees.

Therefore, when the distribution pipe 60 is directly welded to the refrigerant pipe 50, the temperature of the refrigerant pipe 50 rapidly rises while the temperature of the distribution pipe 60 slowly rises due to the thickness of the refrigerant pipe 50 being thinner than that of the distribution pipe 60, and thus when the temperature of the aluminum solder 40 reaches a melting point, the refrigerant pipe 50 may be overheated beyond a melting point and damaged.

Such an overheat damage attributes to a small difference in melting points between the aluminum solder 40 and the base material even with a significant difference in heat capacities between the refrigerant pipe 50 and the distribution pipe 60.

Therefore, the disclosure may use the connecting member 100 that has the same thickness as the distribution pipe 60 and a net volume in a certain range of the net volume of the bending pipe 30, to prevent damage due to overheating of the refrigerant pipe 50 and reduce probability of poor welding.

That is, the net volume of the connecting member 100 may be set to 65% or more and 135% or less of the net volume of the bending pipe 30.

In other words, the net volume of the connecting member 100 may be provided to be larger than the net volume of the bending pipe 30 within a range of 35% of the net volume of the bending pipe 30, or may be provided to be smaller than the net volume of the bending pipe 30 within a range of 35% of the net volume of the bending pipe 30.

The bending pipe 30 may be provided with specifications that allow automatic welding with the refrigerant pipe 50.

That is, the volume of the bending pipe 30 may be determined with the thickness and the volume that ensures no damage caused by a temperature difference between the two members heated during automatic welding in consideration of the heat transfer rate of the refrigerant pipe 50 and the fin.

However, the net volume of the refrigerant pipe 50 exposed outside of the support plate 20 is not limited thereto, and may be designed to vary based on various external conditions, such as welding conditions and flame intensity.

According to one embodiment of the disclosure, the net volume of the connecting member 100 may be set to 65% or more and 135% or less of the net volume of the bending pipe 30, so that the automatic welding design of the bending pipe 30 and the refrigerant pipe 50 is not changed, and simultaneously, automatic welding of the connecting member 100 and the refrigerant pipe 50 may be performed.

With such a configuration, the disclosure may set the heat capacities of the connecting member 100 and the bending pipe 30 as similar as possible, so that the welding completeness during the primary automatic welding may be increased, thereby reducing the probability of defects due to overheating or non-melting of the heat exchanger 1.

In addition, according to the disclosure, first, the connecting member 100 together with the bending pipe 30 may be automatically welded to the refrigerant pipes 50, and then secondarily, the distribution pipe 60 is manually welded to the connecting member 100 connected to the refrigerant pipe 50, and thus the welding completeness may be improved.

The thickness of the connecting member 100 may be the same as or similar to that of the distribution pipe 60. Accordingly, in a range of the secondary manual welding, the heat capacities of the connecting member 100 and the distribution pipe 60 may be provided similar as each other.

Accordingly, the disclosure may have a technical effect capable of reducing the probability of defects, such as of overheating or non-melting that may occur during manual welding, regardless of the skill level of the technician.

In addition, according to the disclosure, a method of manufacturing a heat exchanger 1 including a refrigerant pipe 50, a bending pipe 30 coupled to the refrigerant pipe 50, a connecting member 100 coupled to the refrigerant pipe 50, and a distribution pipe 60 coupled to the connecting member 100 to allow a refrigerant to be introduced or discharged may include performing primarily welding on the bending pipe 30 and the connecting member 100 and performing secondarily welding on the connecting member 100 and the distribution pipe 60.

The thickness of the refrigerant pipe 50 may be formed with a first thickness d1, and the thickness of the bending pipe 30 and the connecting member 100 and the thickness of the distribution pipe 60 may be formed with a second thickness d2 greater than the first thickness d1.

In addition, the bending pipe 30 and the connecting member 100 may be subject to automatic welding, and the connecting member 100 and the distribution pipe 60 may be subject to manually welding.

The refrigerant pipe 50, the bending pipe 30, the connecting member 100, and the distribution pipe 60 may include an aluminum material.

As is apparent from the above, a refrigerant pipe and a distribution pipe are connected using a connecting member having a certain level of heat capacity, such that welding defects, such as overheating or un-melting, can be prevent during automatic and manual welding.

Embodiments of the disclosure may provide a method of manufacturing a heat exchanger including a refrigerant pipe, a bending pipe coupled to the refrigerant pipe, a connecting member coupled to the refrigerant pipe, and a distribution pipe coupled to the connecting member to allow a refrigerant to flow in or out, the method including primarily welding the bending pipe and the connecting member. The method may include secondarily welding the connecting member and the distribution pipe. The connecting member may have a net volume greater than or equal to 65% and less than or equal to 135% of a net volume of the bending pipe. The thickness of the refrigerant pipe may be formed with a first thickness, and the thickness of the bending pipe and the connecting member and the distribution pipe may be formed with a second thickness greater than the first thickness. The connecting member may include: a connecting body inserted into the refrigerant pipe and allowing a portion of the distribution pipe to be inserted thereinto. The connecting body may include: a first connecting body; a second connecting body having an inner diameter that is larger than an inner diameter of the first connecting body and formed on an upper side of the first connecting body. The bending pipe and the connecting member may be subject to automatically welding. The connecting member and the distribution pipe may be subject to manually welding. The refrigerant pipe, the bending pipe, the connecting member, and the distribution pipe may include an aluminum material.

A specific shape and a specific direction of a washing machine have been described above with reference to the accompanying drawings, but the present disclosure may be variously modified and changed by those skilled in the art, and the modifications and changes should be interpreted as being included in the scope of the present disclosure.

What is claimed is:

1. A heat exchanger comprising:

a heat exchange fin;

a refrigerant pipe passing through the heat exchange fin, the refrigerant pipe having a first thickness;

a connecting member coupled to the refrigerant pipe; and a distribution pipe coupled to the connecting member at an outside of the heat exchange fin, the distribution pipe having a second thickness greater than the first thickness, wherein the connecting member is positioned between the refrigerant pipe and the distribution pipe so that a refrigerant is flowable through the connecting member between the refrigerant pipe and the distribution pipe, and has a thickness in a range of 95% or more and 105% or less of the second thickness, and wherein the distribution pipe includes:

an insertion portion inserted into the connecting member, an expansion pipe portion extending upward and outward from the insertion portion such that an inner diameter of the expansion pipe portion increases along a length of the distribution pipe, and an extension portion extending upward from the expansion pipe portion and having an inner diameter that is larger than an inner diameter of the insertion portion.

2. The heat exchanger of claim 1, wherein the connecting member includes:

a connecting body configured to be in contact with the refrigerant pipe and the distribution pipe, and an expansion flange formed on an upper end of the connecting body and extending upward and outward from the connecting body such that an inner diameter of the expansion flange increases along a length of the expansion flange.

3. The heat exchanger of claim 2, wherein the connecting body includes:

a first connecting body, a second connecting body having an inner diameter that is larger than an inner diameter of the first connecting body, and being formed on an upper side of the first connecting body, and a connecting expansion portion connecting the first connecting body and the second connecting body, and obliquely extending from the first connecting body to the second connecting body.

4. The heat exchanger of claim 2, wherein the insertion portion is inserted into the connecting body, and the expansion pipe portion is supported by the expansion flange of the connecting member.

5. The heat exchanger of claim 2, wherein the connecting member is coupled to the refrigerant pipe such that the connecting body is inserted into the refrigerant pipe, and coupled to the distribution pipe such that the distribution pipe is inserted into the connecting body.

6. The heat exchanger of claim 3, wherein the refrigerant pipe includes:

a refrigerant pipe body, and a refrigerant pipe expansion portion extending upward from the refrigerant pipe body such that an inner diameter of the refrigerant pipe expansion portion increases as in an upward direction, the refrigerant pipe expansion portion being configured to support an outer surface of the connecting expansion portion.

7. The heat exchanger of claim 1, wherein the refrigerant pipe is configured as a plurality of refrigerant pipes, and the heat exchanger further comprises:

a bending pipe having the second thickness and coupled to open ends of two refrigerant pipes disposed side by side among the plurality of refrigerant pipes to connect the two refrigerant pipes.

8. The heat exchanger of claim 7, wherein the connecting member has a net volume greater than or equal to 65%, and less than or equal to 135%, of a net volume of the bending pipe.

9. The heat exchanger of claim 7, wherein the connecting member and the bending pipe are automatically welded to the refrigerant pipe.

10. The heat exchanger of claim 9, wherein the distribution pipe is manually welded to the connecting member after the bending pipe and the connecting member are welded.

11. The heat exchanger of claim 1, wherein the first thickness is greater than or equal to 0.45 mm and less than or equal to 0.55 mm, and the second thickness is greater than or equal to 0.9 mm and less than or equal to 1.1 mm.

12. The heat exchanger of claim 1, further comprising:

an aluminum solder disposed between the refrigerant pipe and the connecting member and coupling the connecting member and the refrigerant pipe together.

13. The heat exchanger of claim 1, wherein the refrigerant pipe, the distribution pipe, and the connecting member include an aluminum material, the refrigerant pipe and the connecting member are welded together, and the connecting member and the distribution pipe are welded together.

* * * * *